US010539331B2

(12) United States Patent
Seok et al.

(10) Patent No.: US 10,539,331 B2
(45) Date of Patent: Jan. 21, 2020

(54) COOKING APPLIANCE

(71) Applicant: LG ELECTRONICS INC., Seoul (KR)

(72) Inventors: Jun Ho Seok, Seoul (KR); Youngsoo Kim, Seoul (KR); Jong Ho Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 209 days.

(21) Appl. No.: 15/696,749

(22) Filed: Sep. 6, 2017

(65) Prior Publication Data

US 2018/0347828 A1 Dec. 6, 2018

(30) Foreign Application Priority Data

Jun. 5, 2017 (KR) ..... 10-2017-0069812

(51) Int. Cl.
*F24C 15/32* (2006.01)
*F24C 3/00* (2006.01)
*F24C 15/20* (2006.01)

(52) U.S. Cl.
CPC ..... *F24C 15/322* (2013.01); *F24C 3/004* (2013.01); *F24C 15/2007* (2013.01)

(58) Field of Classification Search
CPC ..... F24C 15/322; F24C 15/325
See application file for complete search history.

(56) References Cited

U.S. PATENT DOCUMENTS 4,357,522 A * 11/1982 Husslein ..... F24C 15/325 219/400
5,205,273 A 4/1993 Sparks et al.
5,816,234 A * 10/1998 Vasan ..... F24C 15/322 126/21 A
9,534,791 B2 * 1/2017 Wie ..... F24C 3/025
(Continued)

FOREIGN PATENT DOCUMENTS

DE 20309268 U1 6/2004
JP 10-038280 2/1998
(Continued)

OTHER PUBLICATIONS

Korean Notice of Allowance issued in application No. 120020128403 dated Jul. 27, 2018.
(Continued)

*Primary Examiner* — David J Laux
(74) *Attorney, Agent, or Firm* — Ked & Associates, LLP

(57) ABSTRACT

A cooking appliance for cooking food or other items is provided. The cooking appliance may include a main body having a cooking chamber; a fan cover provided on a back surface and forming an accommodation space separated within the cooking chamber, the fan cover having a suction port at a front of the fan cover and at least one exhaust port at a side of the fan cover; a heating element provided in the accommodation space to generate heat; a convection fan that generates an air circulation flow in the cooking chamber; and at least one guide vane, provided between a side surface of the cooking chamber and the at least one exhaust port, that guides a flow of air so that air discharged toward the side surface through the at least one exhaust port flows toward a front of the cooking chamber.

15 Claims, 7 Drawing Sheets

(56) References Cited

U.S. PATENT DOCUMENTS

| | | | | |
|---|---|---|---|---|
| 2011/0083657 | A1* | 4/2011 | Ploof | F24C 15/322 126/21 A |
| 2016/0258633 | A1* | 9/2016 | Yang | F24C 15/322 |

FOREIGN PATENT DOCUMENTS

| | | |
|---|---|---|
| KR | 10-2004-0088031 | 10/2004 |
| KR | 10-2014-0067731 | 6/2014 |
| KR | 10-2016-0107946 | 9/2016 |
| WO | WO 2006/122118 A2 | 11/2006 |

OTHER PUBLICATIONS

European Search Report dated May 17, 2018.
Korean Office Action dated Jan. 9, 2018.

* cited by examiner

COOKING APPLIANCE

CROSS-REFERENCE TO RELATED APPLICATION(S)

This application claims priority to and the benefit of Korean Patent Application No. 10-2017-0069812, filed in Korea on Jun. 5, 2017, the disclosure of which is incorporated herein by reference in its entirety.

BACKGROUND

1. Field

A cooking appliance is disclosed herein.

2. Background

A cooking appliance is a home appliance for cooking food or other items (hereinafter collectively referred to as "food") and is installed in a kitchen space. The cooking appliance cooks food according to a user's intention. Such a cooking appliance can be classified as various types according to a heat source, a cooking type, or a type of fuel.

When the cooking appliance is classified according to the cooking type, it can be classified as an open type cooking appliance or a closed type cooking appliance depending on a type of a space in which the food is placed. The closed type cooking appliance includes ovens and microwave ovens, for example, and the open type cooking appliance includes cooktops and hobs, for example.

The closed type cooking appliance is a cooking appliance which shields a space in which food is placed and heats the shielded space to cook the food. The closed cooking appliance includes a cooking chamber, which is a space which is shielded when food to be cooked is placed in the cooking chamber. Such a cooking chamber becomes the space in which food is cooked.

The closed cooking appliance includes a rotatable door that selectively opens and closes the cooking chamber. The door is rotatably installed on a main body by a door hinge provided between the main body having the cooking chamber and the door. The door can rotate around a portion which is connected with the main body through the door hinge so that the cooking chamber can be selectively opened and closed.

In the internal space of the cooking chamber which is opened and closed by the door, a heat source is provided to heat the cooking chamber. A gas burner, or an electric heater, for example, may be used as the heat source.

In the closed type cooking appliance in which the gas burner is used as a heat source, a plurality of burners may be provided to heat the food inside of the cooking chamber. For example, a broil burner may be installed at an upper portion of the cooking chamber, and a bake burner may be installed at a lower portion or a rear side of the cooking chamber.

Each of the burners includes a burner port through which a mixed gas supplied into the burner is discharged. The mixed gas discharged from the burner port is ignited by an ignition device to form a flame, and a gas oven can cook food by heating the food inside of the cooking chamber using the flame generated in this manner.

When gas is supplied into the burner, a portion of the air (hereinafter referred to as "first portion of air") necessary for burning is also supplied and mixed with the gas, and the mixed gas of the air and the gas is burned in the burner port. Then, a fresh portion of air (referred to as "second portion of air") flows into the flame again, thereby achieving complete combustion. Only when a sufficient amount of the second portion of air is supplied can complete combustion be achieved, and thus, thermal efficiency of the burner increased.

A convection device may further be provided at a rear side of the cooking chamber. The convection device serves to circulate the air inside of the cooking chamber so as to uniformly distribute the heat to the entire cooking chamber, and may include a fan cover installed on a rear wall of the cooking chamber and a convection fan installed in an internal space of the fan cover.

The fan cover includes a suction port and an outlet. The suction port is formed at a front center of the fan cover facing the door, and the outlet is formed at a side of the fan cover facing a side surface of the cooking chamber.

The convection fan is rotated inside the fan cover and is operated to generate an air flow. Such a convection fan can generate an air circulation flow in which the air of the cooking chamber is suctioned into the fan cover through the suction port and the air heated inside the fan cover is discharged to the cooking chamber through the outlet.

The air discharged through the outlet of the fan cover flows toward a front center of the cooking chamber on the side surface of the cooking chamber. The heat is uniformly distributed to the entire cooking chamber only when the air discharged through the outlet of the fan cover flows smoothly toward a front of the cooking chamber.

When the flow of air discharged through the outlet of the fan cover toward the front of the cooking chamber is not smooth, the heat transferred from a rear of the cooking chamber cannot be transmitted to a front side of the cooking chamber, and a circulation flow is achieved only in the rear of the cooking chamber, so that it is difficult to uniformly transfer heat to the entire cooking chamber. Accordingly, the fan cover is designed to have an optimized size and shape in order to smoothly flow the air discharged through the outlet of the fan cover toward the front of the cooking chamber in consideration of a performance of the convection fan, and a volume of the cooking chamber, for example.

Such a design of the fan cover requires extensive design and manufacturing time and high costs. In a case of manufacturing a closed type cooking appliance having a different volume of the cooking chamber from the conventional closed type cooking appliance to which the fan cover is applied, it is necessary to optimize the design of the fan cover again. However, when the fan cover is designed and manufactured for each of the various closed type cooking appliances having different cooking chamber volumes, the time and the cost for designing and manufacturing components increase, components management becomes more difficult, and components management cost increase.

BRIEF DESCRIPTION OF THE DRAWINGS

Embodiments will be described in detail with reference to the following drawings in which like reference numerals refer to like elements, and wherein.

DETAILED DESCRIPTION

Figure 1:
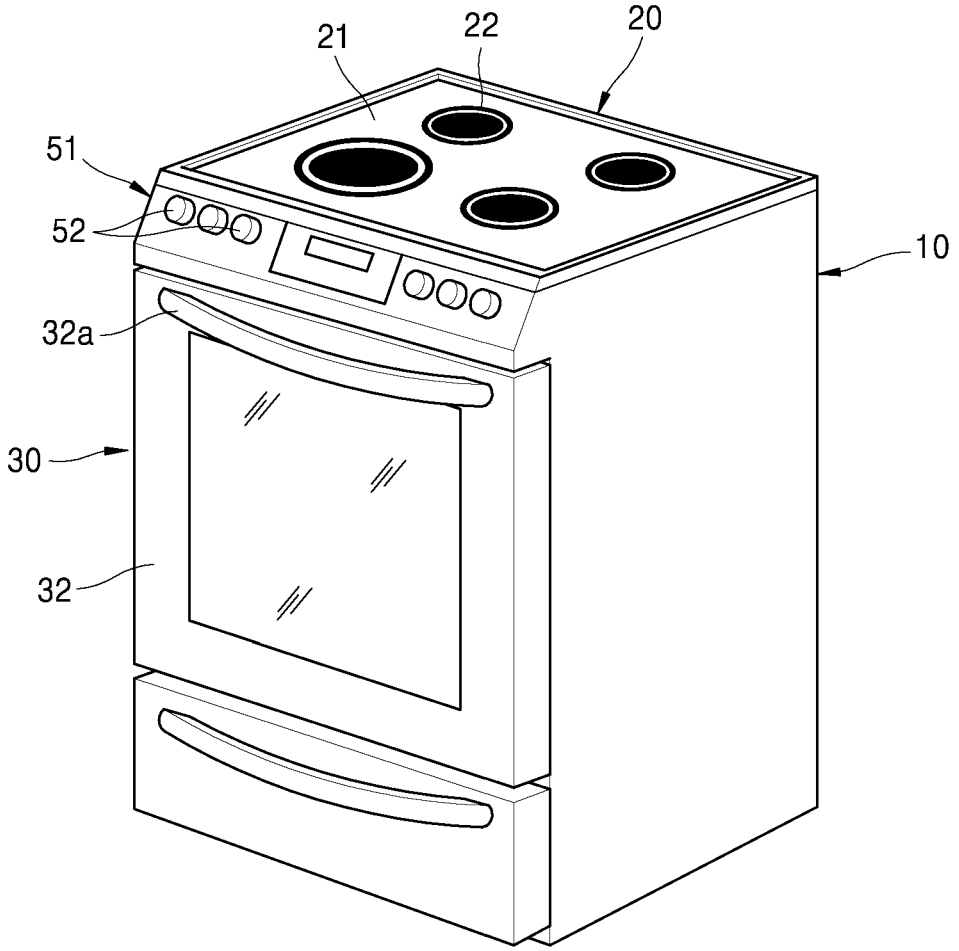
FIG. 1 is a perspective view schematically illustrating a cooking appliance according to an embodiment.
Figure 2:
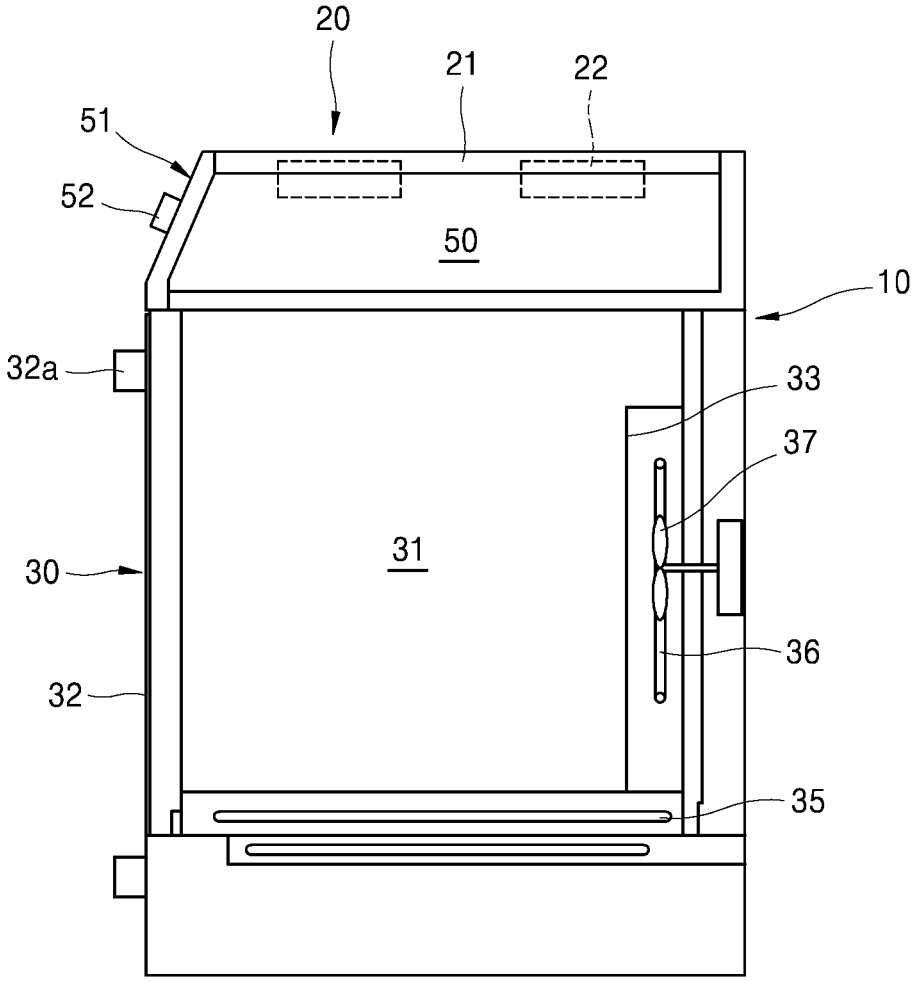
FIG. 2 is a side view schematically illustrating an internal structure of the cooking appliance of FIG. 1.

FIG. 1 is a perspective view schematically illustrating a cooking appliance according to an embodiment, FIG. 2 is a side view schematically illustrating an internal structure of the cooking appliance of FIG. 1. Referring to FIGS. 1 and 2, an external appearance of the cooking appliance may be formed by a main body 10. The main body 10 may have a roughly rectangular parallelepiped shape and may be formed of a material having a certain strength to protect a components provided in an internal space.

In or at an upper end of the main body 10, a cooktop portion or cooktop 20 may be located which may be used to cook food or other items (hereinafter, collectively "food"), that is, food or a container containing food placed at an upper side by heating an open space. The cooktop 20 may include an upper plate 21 that supports food to be cooked or a container containing food while forming an upper surface of the body 10.

The food to be cooked or the container containing food may be placed on a top side of the upper plate 21. Beneath a lower side of the upper plate 21, at least one heating portion 22 may be formed to heat food to be cooked or the container containing food.

An oven portion or oven 30 may be installed or provided beneath the cooktop 20. In an internal space of the oven 30, a cooking chamber 31 may be formed in which food may be cooked. The cooking chamber 31 may have the form of a hexahedron having an open front side. An internal space of the cooking chamber 31 may be heated to cook food when the cooking chamber 31 is shielded. That is, the internal space of the cooking chamber 31 may be a space in which food is cooked.

A door 32 that selectively opens and closes the cooking chamber 31 may be rotatably attached to the oven 30. The door 32 may open and close the cooking chamber 31 in a pull-down manner in which an upper end of the door 32 rotates up and down about a lower end thereof.

The door 32 may be formed in a hexahedron shape having a certain thickness. A handle 32*a* may be provided on a front surface of the door 32 so that a user may grasp the handle 32*a* when the user desires to rotate the door 32. The user may easily rotate the door 32 by way of the handle 32*a*.

A control panel 51 may be provided on a front surface of the cooktop 20, that is, at an upper side of the door 32. The control panel 51 may be in the form of a hexahedron having a certain internal space. A front surface of the control panel 51 may include an input portion or input 52 into which the user may input an operation signal to operate the cooktop 20 and/or the oven 30. The input 52 may include a plurality of operation switches through which the user may directly input an operation signal.

The control panel 51 may further include a display unit or display which provides operation information of the cooking appliance, and cooking information of the food, for example, so that the user may check various information. An electric apparatus chamber 50 may be formed in the internal space of the main body 10, that is, the space between the cooktop 20 and the oven 30, and may provide a space in which electrical components may be located. The control panel 51 may be provided on a front surface of the electric apparatus chamber 50, and the control panel 51 may shield the front surface of the electric apparatus chamber 50.

Figure 3:
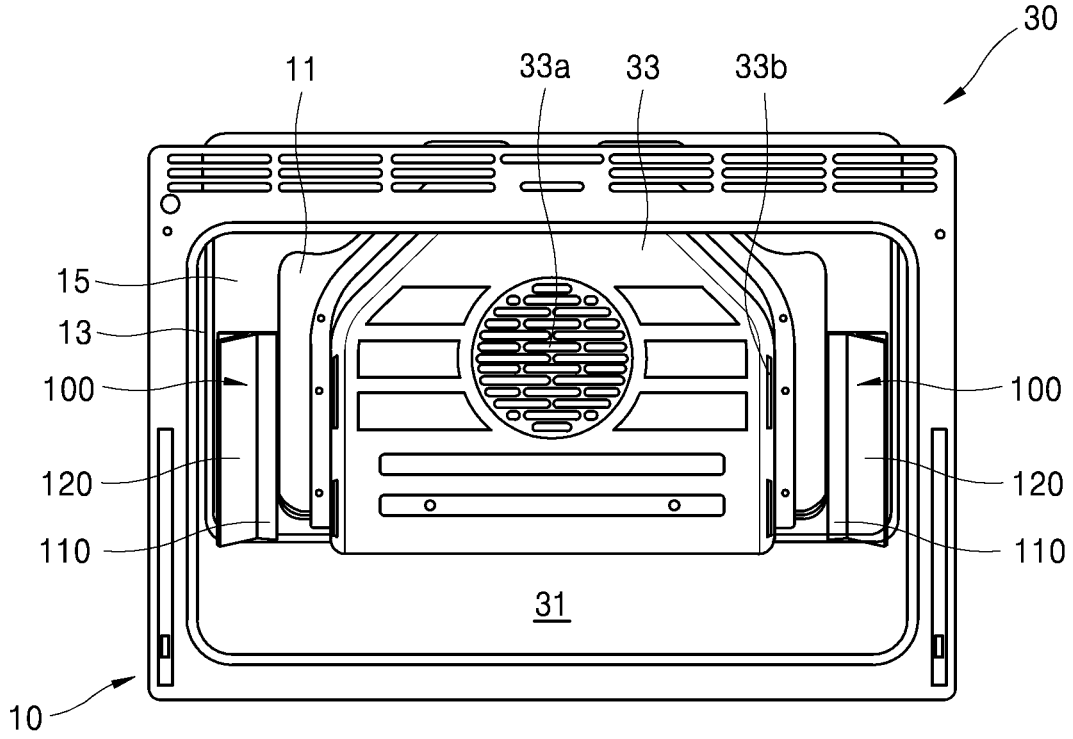
FIG. 3 is a front perspective view illustrating an oven portion structure of the cooking appliance of FIG. 1.
Figure 4:
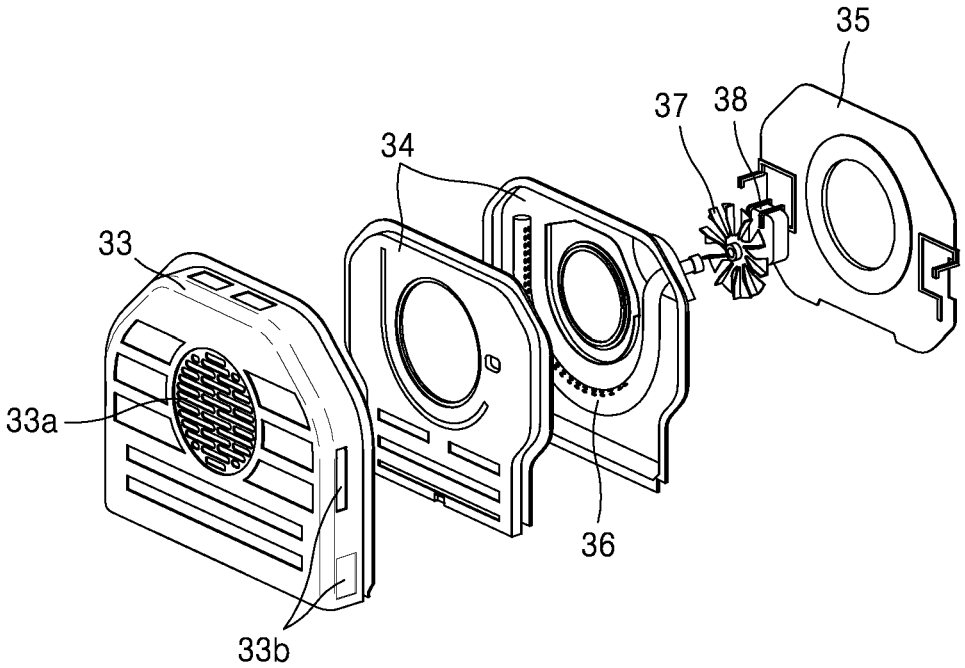
FIG. 4 is an exploded perspective view of a fan cover, a heating portion, and a convection fan of the oven shown in FIG. 3.

FIG. 3 is a front perspective view illustrating an oven of the cooking appliance of FIG. 1. FIG. 4 is an exploded perspective view of a fan cover, a heating portion, and a convection fan of the oven shown in FIG. 3.

Referring to FIGS. 2 to 4, the oven 30 of the cooking appliance may include the main body 10 which forms a skeleton of the oven 30, the door 32 which is provided at the front side of the main body 10 and which opens and closes the cooking chamber 31, a fan cover 33 which is provided inside of the cooking chamber 31, a heating portion or element 36, a convection fan 37, and one or more airflow guide member or guide vane 100.

According to an embodiment, the main body 10 may be formed to have a roughly rectangular parallelepiped shape, and may include a back surface portion or back surface 11 and a side surface portion or side surface 13. The back surface 11 may be located at a rear side of the main body 10, and may define a rear boundary surface of the cooking chamber 31. The back surface 11 may form a rear surface of the cooking chamber 31 and may form a wall surface on which the fan cover 33 may be installed or provided and positioned behind the cooking chamber 31. The side surface 13 may be located on or near the rear side of the main body 10, and may define a lateral boundary surface of the cooking chamber 31. The side surface 13 may form the side surface of the cooking chamber 31 and may form a wall surface facing an exhaust port 33*b* formed on the side surface of the fan cover 33, which are described hereinafter.

The fan cover 33 may be installed or provided on or at the rear side of the main body 10, or more specifically, on the back surface 11 forming the rear side of the cooking chamber 31. For example, the fan cover 33 may be in the form of a hexahedron having an open rear surface. The fan cover 33 may be coupled to the back surface 11 in such a manner that the open rear surface of the fan cover 33 is covered by the back surface 11 to form an accommodation space separated inside of the cooking chamber 31.

The fan cover 33 may include a suction port 33*a* and the exhaust port 33*b*. The suction port 33*a* may penetrate the front surface of the fan cover 33 toward the front side of the cooking chamber 31, and the exhaust port 33*b* may penetrate the side surface of the fan cover 33 facing the side surface 13.

The heating element 36 may be installed or provided in the accommodation space inside of the fan cover 33 to generate heat. The heating element 36 may be in the form of a bake burner installed or provided on the rear surface of the cooking chamber 31. Further, the heating element 36 may include a plurality of burner ports formed on a side of a burner main body provided in such a manner that a hollow pipe is extended to form a "U" shape.

A flow channel to supply a mixed gas may be formed inside of the burner main body, and the plurality of burner ports may form a passage or passages through which the gas supplied into the burner main body may be discharged outside of the burner main body. The plurality of burner ports may be provided on the side of the burner main body to be spaced apart from each other along an extending direction of the burner main body, or a plurality of gas discharge passages may be provided in the burner main body along the extending direction of the burner main body.

The burner main body may be supplied with a gas mixed with the air, that is, a mixed gas through a mixing tube connected to the burner main body. The mixed gas supplied to a flow channel inside of the burner main body may be discharged outside of the burner main body through the plurality of burner ports and may be burned to generate a flame outside of the heating element 36, that is, in the accommodation space inside of the fan cover 33.

The cooking appliance may further include a burner cover 34. The burner cover 34 may be located in the accommodation space inside of the fan cover 33 and may include a pair of cover plates which may be coupled to each other. A space may be formed between the cover plates in which the heating element 36 may be accommodated and the flame generated in the heating element 36 may be enclosed. Such a burner cover may stabilize the flame generated in the heating element 36 by restricting an area in which the flame is diffused, and prevent the flame from directly coming in contact with the fan cover 33 and the wall surface of the cooking chamber 31.

The cooking appliance may further include a reflecting or reflector plate 35. The reflector plate 35 may be positioned in the accommodation space inside of the fan cover 33, or between the burner cover 34 and the rear wall of the cooking chamber 31. The reflector plate 35 may prevent, to a certain extent, heat from the flame generated in the heating element 36 from being transmitted to the rear wall of the cooking chamber 31. Thus, it may protect a coating layer, such as an enamel formed on the surface of the cooking chamber 31, from damage caused by heat.

The convection fan 37 may be provided in the accommodation space inside of the fan cover 33. The convection fan 37 may be rotated by driving a convection motor 38 connected to the convection fan 37 to generate an air flow. The convection fan 37 operated as described above may generate an air circulation flow in which the air in the cooking chamber 31 is suctioned into the accommodation space inside of the fan cover 33 through the suction port 33*a*, and the air suctioned into and heated in the accommodation space inside of the fan cover 33 may be discharged to the cooking chamber 31 through the exhaust port 33*b*.

The fan cover 33 and the convection fan 37 may generate an air circulation flow which allows the air discharged to the side surface 13 through the exhaust port 33*b* to flow toward the front side of the cooking chamber 31 at at least a certain or predetermined rate when the side surface 13 is provided at a position spaced apart from the exhaust port 33*b* by a first distance. That is, the fan cover 33 and the convection fan 37 may generate an optimum air circulation flow in which the air discharged toward the side surface 13 through the exhaust port 33*b* may flow toward the front side of the cooking chamber 31 at at least a certain or predetermined rate and may evenly spread throughout the entire cooking chamber 31, under the condition that the fan cover 33 and the convection fan 37 are installed or provided in the oven 30 having a specific size or specification (hereinafter referred to as "oven of a first specification") in which a size of the main body 10, a size of the fan cover 33, and an installation position of the fan cover 33 are determined so that the side surface 13 is provided at a position spaced apart from the exhaust port 33*b* by a first distance, for example, in a 30-inch size oven.

Therefore, when the fan cover 33 and the convection fan 37 are provided in an oven having a larger size or specification than that of the 30-inch oven portion (hereinafter referred to as "oven of a second specification"), for example, in a 36-inch size oven, the air may be discharged through the exhaust port 33*b* under the condition that the distance between the side surface 13 and the exhaust port 33*b* is longer than the first distance, so that the air discharged to the side surface 13 through the exhaust port 33*b* cannot flow to the front side of the cooking chamber 31 at a certain rate or more. When the air discharged to the side of the side surface 13 through the exhaust port 33*b* cannot flow to the front side of the cooking chamber 31 at a certain rate or more, a circulation flow in which the heat generated at the rear side of the cooking chamber cannot be transmitted to the front side of the cooking chamber sufficiently and is circulated only in the rear side of the cooking chamber may happen, so that it may be difficult to uniformly distribute heat throughout the cooking chamber.

In consideration of this point, the one or more guide vane 100 may be provided inside of the oven 30. The guide vane 100 may be provided at both side portions or sides of the fan cover 33, respectively, and may be provided between the side surface 13 and the exhaust port 33*b* by a second distance which is longer than the first distance. The guide vane 100 may guide the flow of air so that the air discharged to the side surface 13 through the exhaust port 33*b* may flow toward the front side of the cooking chamber 31.

The main body 10 forming the oven 30 of the second specification may further include an extended connection surface portion or extended connection surface 15. The extended connection surface 15 may be formed in a same plane as the back surface 11 and may connect the back surface 11 and the side surface 13 so that the side surface 13 forming the side surface of the cooking chamber 31 is spaced from the exhaust port 33*b* by the second distance which is longer than the first distance.

That is, in the oven 30 of the second specification, the rear surface of the cooking chamber 31 may have a width corresponding to a sum of a width of the back surface 11 and a width of a pair of extended connection surfaces 15 which may be connected to both sides of the back surface 11, so that the exhaust port 33*b* and the side surface 13 are spaced apart from each other by the second distance which is longer than the first distance. In addition, in the oven 30 of the second specification, the guide vane 100 may be installed or provided on the extended connection surface 15 so as to be provided between the exhaust port 33*b* and the side surface 13 which are spaced by the second distance.

The first distance may be a separation distance between the exhaust port 33*b* and the side surface 13 in the oven 30 of the first specification, and the second distance may be a separation distance between the exhaust port 33*b* and the side surface 13 in the oven 30 of the second specification. That is, the first distance may be a distance between a first side surface (left in the drawings) of the fan cover 33 and a first side surface 13 facing the left side surface of the fan cover 33, or a distance between a second side surface of the fan cover 33 (right in the drawings) and a second side surface 13 facing the second side surface of the fan cover 33, in the oven 30 of the first specification, in which the extended connection surface 15 is not formed on the rear surface, The second distance may be a distance between the first side surface of the fan cover 33 and the first side surface 13 facing the first side surface of the fan cover 33, or a distance between the second side surface of the fan cover 33 and the second side surface 13 facing the second side surface of the fan cover 33, in the oven 30 of the second specification, in which the extended connection surface 15 is formed between the side surface of the fan cover 33 and the side surface 13. In the oven 30 of the second specification, in comparison with the oven 30 of the first specification, the distance between the side surface of the fan cover 33 and the side surface 13 facing the side surface of the fan cover 33 may be increased by the width of the extended connection surface 15. Thus, the second distance may be longer than the first distance by a distance corresponding to the width of the extended connection surface 15.

Figure 5:
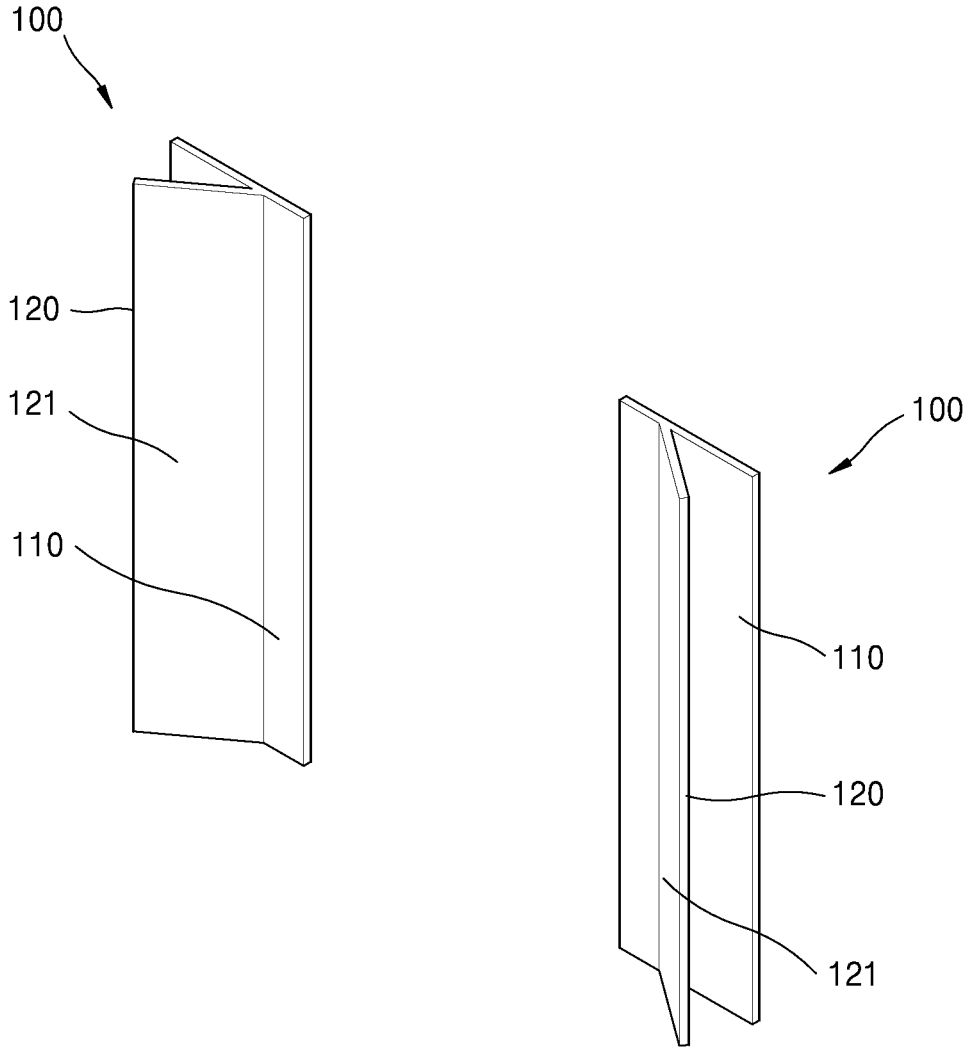
FIG. 5 is a perspective view of a guide vane shown in FIG. 3 according to an embodiment.
Figure 6:
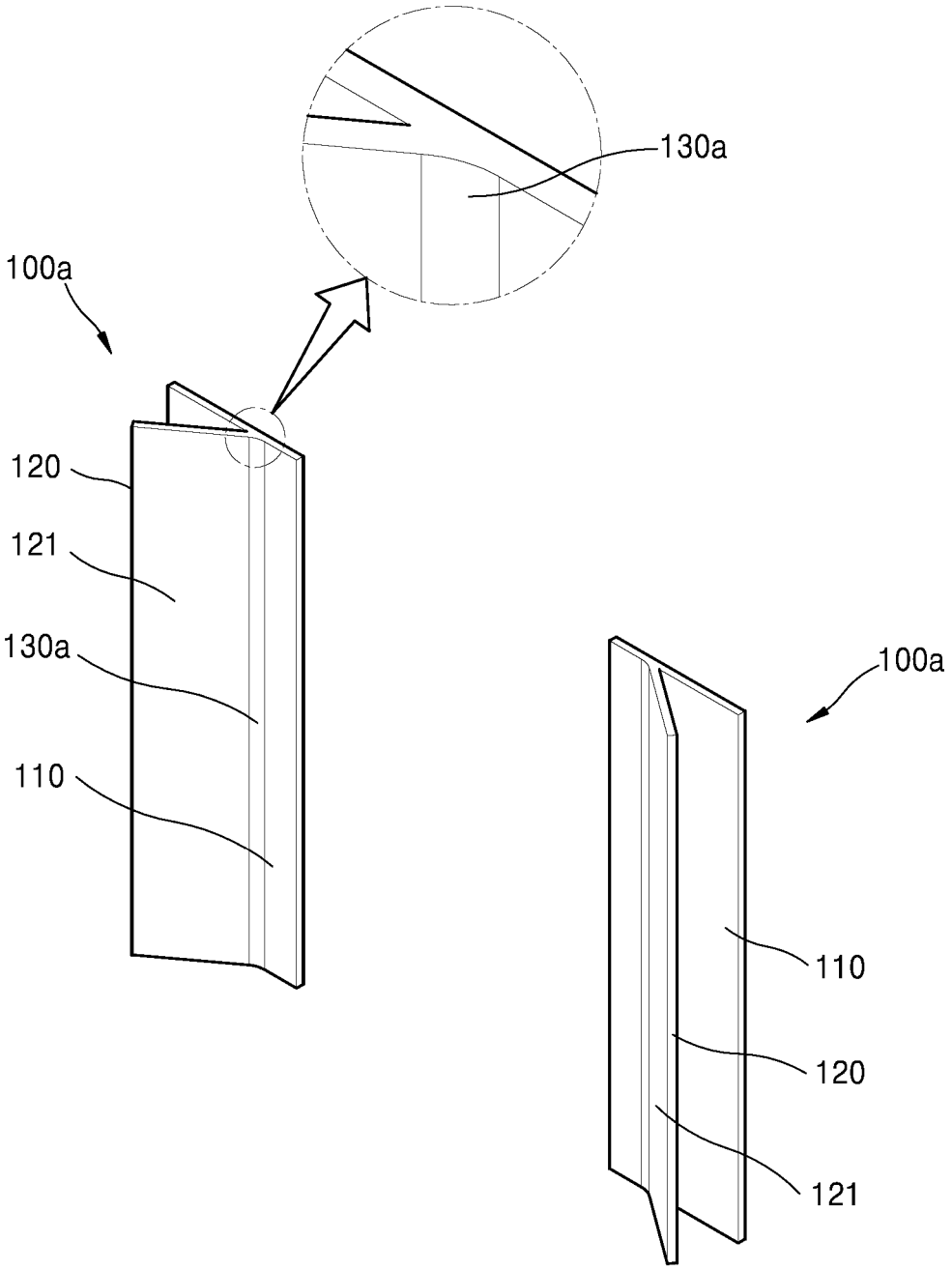
FIG. 6 is a perspective view of a guide vane according to another embodiment.
Figure 7:
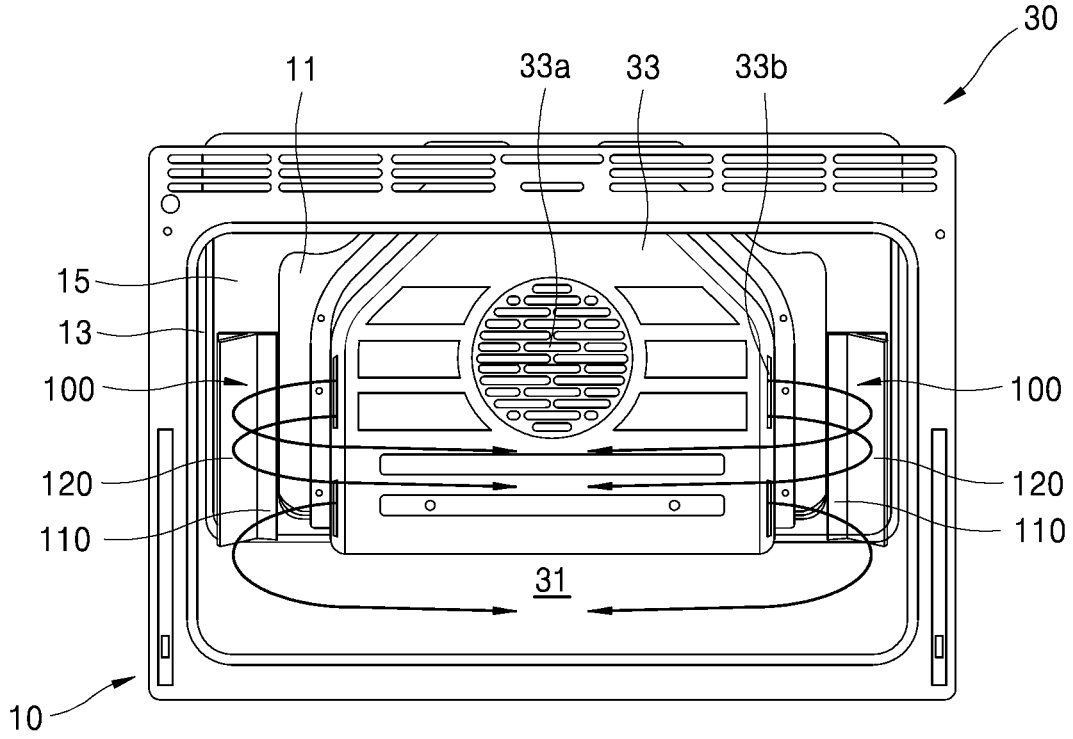
FIG. 7 is a front perspective view illustrating a heat flow state in the oven of the cooking appliance of FIG. 1.

FIG. 5 is a perspective view of a guide vane shown in FIG. 3 according to an embodiment. FIG. 6 is a perspective view of a guide vane shown in FIG. 3 according to another embodiment. FIG. 7 is a front perspective view illustrating a heat flow state in the oven of the cooking appliance of FIG. 1.

Referring to FIGS. 3 and 5, each guide vane 100 may include a coupling portion or plate 110, and a guide portion or plate 120. The coupling plate 110 may couple the guide vane 100 to the extended connection surface 15. The coupling plate 110 may be formed in a flat plate shape parallel to the extended connection surface 15 and may be coupled with the extended connection surface 15 in a surface contact manner. The coupling plate 110 may form a plane extending in a direction parallel to the direction of the flow of air discharged through the exhaust port 33*b*, and may be formed in an elongated flat plate shape in a longitudinal direction. The coupling plate 110 may have a vertical length approximately equal to a vertical length of the cooking chamber 31.

The guide plate 120 may protrude from the coupling plate 110 toward the front side of the cooking chamber. The guide plate 120 may guide the flow of air that is discharged to the side surface 13 through the exhaust port 33*b* to be directed to the front side of the cooking chamber 31. The guide plate 120 may be provided between the exhaust port 33*b* and the side surface 13 so that the distance between the exhaust port 33*b* and the guide plate 120 is shorter than the distance between the exhaust port 33*b* and the side surface 13.

The guide plate 120 may be spaced a first distance apart from the exhaust port 33*b*. In this case, contact between the air exhausted to the side surface 13 through the exhaust port 33*b* and the guide plate 120 may be achieved at a position spaced apart from the exhaust port 33*b* by a first distance. Accordingly, an air flow may be achieved in a similar manner to the air flow in which the air discharged from the oven 30 of the first specification toward the side surface 13 side through the exhaust port 33*b* comes into contact with the side surface 13.

A flow guide surface 121 that guides the flow of air which is discharged through the exhaust port 33*b* toward the side surface 13 may be formed on a first side surface of the guide plate 120 facing the exhaust port 33*b*. The flow guide surface 121 may be implemented in the form of a plane facing the exhaust port 33*b*, and may be an inclined surface which is inclined laterally. The inclined surface formed by the flow guide surface 121 may form an obtuse angle with a plane formed by the extended connection surface 15 between the fan cover 33 and the flow guide surface 121; in other words, inclined between the front side of the cooking chamber 31 and the direction of the flow of air discharged through the exhaust port 33*b*. In addition, the inclined surface formed by the flow guide surface 121 may cover an edge connecting the extended connection surface portion 15 and the side surface 13. The guide vane 100 including the coupling plate 110 and the guide plate 120 may form a "λ" shape.

When the air is discharged toward the side surface 13 through the exhaust port 33*b* due to the operation of the convection fan 37, the above mentioned guide vane 100 may block the flow of air which is discharged as described above. The air may then flow in the lateral direction at a position closer to the side surface 13 which is spaced apart from the exhaust port 33*b* by the second distance, thereby guiding the air flow so that the air discharged to the side surface 13 through the exhaust port 33*b* may flow toward the front side of the cooking chamber 31.

At a position at which the guide vane 100 is installed, the direction of air flow may be changed such that the air discharged to the side surface 13 through the exhaust port 33*b* may flow laterally along the plane formed by the coupling plate 110 and the flow direction may be changed along the inclined surface formed by the flow guide surface 121 of the guide plate 120. Alternatively, as shown in FIG. 6, the airflow guide vane 100 may include a curved surface connection portion or curved surface fillet 130*a* between the coupling plate 110 and the guide plate 120.

The curved surface fillet 130*a* may connect the coupling plate 110 and the flow guide surface 121 in the form of a curved surface. This curved surface fillet 130*a* may reduce resistance due to a secondary flow of the air in a portion connecting the coupling plate 110 and the flow guide surface 121. A guide vane 100*a* including the curved surface fillet 130*a* may reduce the resistance of the air flowing along the surface of the guide vane 100*a*, so that the airflow guiding process of the guide vane 100*a* may be effectively performed.

Hereinafter, an operation and effect of the cooking appliance having the guide vane according to an embodiment will be described. Referring to FIG. 7, the side surface 13 forming the side surface of the cooking chamber 31 may be provided at a position spaced from the exhaust port 33*b* by the second distance which is longer than the first distance. This is because the extended connection surface 15 may be formed between the back surface 11 provided with the fan cover 33 and the side surface 13.

By the extended connection surface 15 connecting the back surface 11 and the side surface 13, the size of the oven 30 may be enlarged by the width occupied by the extended connection surface 15. The oven 30 may then form the cooking chamber 31 having an expanded volume, thereby providing the cooking chamber 31 which may cook food of various sizes.

In the oven 30 provided as described above, the guide vane 100 may be provided on both sides of the fan cover 33. Each guide vane 100 may be installed or provided on the extended connection surface 15 so as to be provided between the exhaust port 33*b* and the side surface 13 which are spaced apart by the second distance, for example, at a position spaced apart from the exhaust port 33*b* by the first distance.

The guide vane 100 installed or provided in this manner may guide the flow of air such that the flow of air discharged toward the side surface 13 through the exhaust port 33*b* may be directed toward the front side of the cooking chamber 31. Thus, the guide vane 100 may promote air flow inside of the cooking chamber 31 in a similar manner to the air flow of the oven of the first specification.

Accordingly, the air discharged through the exhaust port 33*b* of the fan cover 33 may flow smoothly toward the front side of the cooking chamber 31, and thus, heat may be uniformly transmitted to the entire cooking chamber 31, so that the food may be cooked evenly. In the cooking appliance provided with the oven 30 having the above-described structure, notably, it may be possible to manufacture the cooking appliance using the fan cover 33 and the convection fan 37 of the same size or specification regardless of the size of the oven 30.

Thus, it may be possible to manufacture a cooking appliance having various sizes of ovens using only one type of the fan cover 33 and the convection fan 37, which may be optimized for the oven having a certain size. For example, assuming that the fan cover 33 and the convection fan 37, which are designed to be optimally installed in a 30-inch size oven, are prepared for the manufacture of a cooking appliance, it may be possible to complete the manufacture of the cooking appliance by omitting the installation of the guide vane 100 when manufacturing the cooking appliance having an oven of the 30 inch size.

In addition, in a case of manufacturing a cooking appliance having an oven of a 36 inch size (larger than the above mentioned oven), only when the guide vane 100 is provided inside of the oven additionally, it may be possible to manufacture a cooking appliance using the fan cover 33 and the convection fan 37 of the same specification used for manufacturing the cooking appliance having an oven of the 30 inch size, without the need to separately prepare the fan cover 33 and the convection fan 37 according to the size of the oven.

That is, the cooking appliance may be manufactured with an oven of various sizes having a different volume of the cooking chamber 31 using the common type of the fan cover 33 and the convection fan 37. Thus, it may be possible to reduce the time and cost required for designing and manufacturing components, and to suppress the increase in the number of components due to the size difference, thereby facilitating components management and reducing the components management cost.

As described above, according to the cooking appliance according to embodiments disclosed herein, it may be possible to manufacture an oven of various sizes having a different volume of cooking chamber using the common type of the fan cover and the convection fan, thereby reducing the time and cost required for designing and manufacturing the components. Further, fewer components may be needed due to the size difference, thereby facilitating components management and reducing the components management cost.

A cooking appliance for cooking food according to embodiments disclosed herein may include a main body which has a cooking chamber formed therein and which includes a back surface defining a rear boundary surface of the cooking chamber and a side surface defining a lateral boundary surface of the cooking chamber; a fan cover which may be installed or provided on the back surface to form an accommodation space separated inside of the cooking chamber, and which may include a suction port which may be formed to penetrate toward a front side of the cooking chamber and an exhaust port which may be formed to penetrate toward the side surface; a heating element which may be installed or provided in an accommodation space inside of the fan cover to generate heat; a convection fan that generates an air circulation flow in which air in the cooking chamber is suctioned into the fan cover through the suction port and the air suctioned into and heated in the fan cover is discharged to the cooking chamber through the exhaust port, and which generates an air circulation flow which allows air discharged to the side surface through the exhaust port to flow toward the front side of the cooking chamber at at least a certain or predetermined ratio when the side surface is provided at a position spaced apart from the exhaust port by a first distance; and at least one airflow guide vane which may be provided between the side surface spaced from the exhaust port by a second distance which is longer than the first distance, and which guides a flow of air so that the air discharged to the side surface through the exhaust port may flow toward the front side of the cooking chamber.

The airflow guide member may include a coupling plate which may be coupled to the main body inside of the cooking chamber; and a guide plate which may protrude from the coupling plate toward the front side of the cooking chamber, and guide the flow of air discharged through the exhaust port to be directed to the front side of the cooking chamber. The guide plate may be provided such that a distance between the exhaust port and the guide plate is shorter than a distance between the exhaust port and the side surface.

The guide plate may include a flow guide surface which may be formed on one or a first side surface of the guide plate facing the exhaust port, and which guide the flow of air discharged through the exhaust port. The flow guide surface may form an obtuse angle with a plane formed by an extended connection surface between the fan cover and the flow guide surface. The guide plate may include a flow guide surface which may be formed on one or a first side surface of the guide plate facing the exhaust port, and guides the flow of air discharged through the exhaust port. The flow guide surface may be inclined in a direction between the front side of the cooking chamber and a direction of the flow of air discharged through the exhaust port.

The guide plate may include a flow guide surface which may be formed on one or a first side surface of the guide plate facing the exhaust port, and guide the flow of air discharged through the exhaust port. The flow guide surface may cover an edge connecting the extended connection surface and the side surface. The coupling plate may form a plane extending in a direction parallel to the direction of the flow of air discharged through the exhaust port. A curved surface fillet, which connects the coupling plate and the guide plate in a form of a curved surface, may be formed in a connection portion between the coupling plate and the guide plate.

The airflow guide vane may form a "λ" shape. The main body may include an extended connection surface which may be formed in a same plane as the back surface and which connects between the back surface and the side surface so that the side surface is provided at a position spaced from the exhaust port by the second distance which is longer than the first distance. The airflow guide vane may be installed or provided on the extended connection surface so as to be arranged between the exhaust port and the side surface.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance comprising:

a main body having a cooking chamber and including a back surface defining a rear boundary surface of the cooking chamber and a side surface defining a lateral boundary surface of the cooking chamber;

a fan cover provided at the back surface and forming an accommodation space inside of the cooking chamber, including a suction port at a front of the fan cover, and at least one exhaust port at at least one side of the fan cover;

a heating element installed in the accommodation space to generate heat;

a convection fan that generates a flow of air such that air in the cooking chamber is suctioned into the fan cover through the suction port, heated in the fan cover, and discharged to the cooking chamber through the at least one exhaust port, the flow of air being discharged to the cooking chamber toward the side surface through the at least one exhaust port to flow toward a front side of the cooking chamber at at least a certain rate when the side surface is spaced from the exhaust port by a first distance; and at least one guide vane, provided between the side surface and the at least one exhaust port, that guides the flow of air such that the air discharged toward the side surface through the at least one exhaust port flows toward the front side of the cooking chamber when the side surface is spaced from the exhaust port by a second distance which is greater than the first distance, wherein the main body includes an extended connection surface which is formed in a same plane as the back surface and which connects the back surface and the side surface so that the side surface is spaced from the at least one exhaust port by the second distance, and wherein the at least one guide vane is provided on the extended connection surface so as to be arranged between the at least one exhaust port and the side surface.

2. The cooking appliance of claim 1, wherein the at least one guide vane includes:

a coupling plate coupled to the main body inside of the cooking chamber; and a guide plate that protrudes from the coupling plate toward the front side of the cooking chamber and guides the flow of air discharged through the at least one exhaust port to be directed to the front side of the cooking chamber.

3. The cooking appliance of claim 2, wherein a distance between the at least one exhaust port and the guide plate is shorter than a distance between the at least one exhaust port and the side surface.

4. The cooking appliance of claim 2, wherein the guide plate includes a flow guide surface which is formed on a first side surface of the guide plate facing the at least one exhaust port, and which guides the flow of air discharged through the at least one exhaust port, and wherein the flow guide surface forms an obtuse angle with a plane formed by the extended connection surface between the fan cover and the flow guide surface.

5. The cooking appliance of claim 2, wherein the guide plate includes a flow guide surface which is formed on a first side surface of the guide plate facing the at least one exhaust port, and which guides the flow of air discharged through the exhaust port, and wherein the flow guide surface forms an inclined surface which is inclined in a direction between the front side of the cooking chamber and a direction of the flow of air discharged through the at least one exhaust port.

6. The cooking appliance of claim 2, wherein the guide plate includes a flow guide surface which is formed on a first side surface of the guide plate facing the at least one exhaust port, and which guides the flow of air discharged through the at least one exhaust port, and wherein the flow guide surface covers an edge connecting the extended connection surface between the fan cover and the flow guide surface and the side surface.

7. The cooking appliance of claim 2, wherein the coupling plate forms a plane extending in a direction parallel to a direction of the flow of air discharged through the at least one exhaust port, and wherein a curved surface fillet which connects the coupling plate and the guide plate, is formed in a connection portion between the coupling plate and the guide plate.

8. The cooking appliance of claim 2, wherein the at least one guide vane forms a "λ," shape.

9. A cooking appliance, comprising:

a main body forming a cooking chamber including a back surface and a side surface;

a fan cover attached to the back surface that forms an accommodation space between the back surface and the fan cover and including a suction port on a first surface and at least one exhaust port on a second surface different from the first surface;

a heating element provided within the accommodation space;

a convection fan provided within the accommodation space and configured to circulate air within the cooking chamber through the accommodation space to be heated by the heating element; and at least one guide vane attached to the back surface and located adjacent to the second surface of the fan cover, wherein the convection fan circulates air from the accommodation space through the at least one exhaust port toward the at least one guide vane which directs the air toward a front of the cooking chamber, wherein the at least one guide vane includes a coupling plate attached directly to the back surface and a guide plate extending from the coupling plate at a predetermined angle with respect to the coupling plate, wherein the guide plate is angled such that a first edge of the guide plate closest to the side surface is closer to the front of the cooking chamber than a second edge of the guide plate closest to the fan cover, and wherein the first and second edges run from a top to a bottom of the guide plate.

10. The cooking appliance of claim 9, wherein the at least one guide vane includes a curved surface fillet connecting a first surface of the coupling plate with a first surface of the guide plate such that air flows from the accommodation space over the first surface of the coupling plate, the curved surface fillet, and the first surface of the guide plate towards the front of the cooking chamber.

11. The cooking appliance of claim 10, wherein the at least one exhaust port includes a first exhaust port on the second surface facing a first side of the cooking chamber and a second exhaust port on a third surface opposite the second surface and facing a second side of the cooking chamber, and wherein the second surface and the third surface are perpendicular to the first surface.

12. The cooking appliance of claim 11, wherein the at least one guide vane includes a first guide vane adjacent to the first exhaust port and a second guide vane adjacent to the second exhaust port.

13. The cooking appliance of claim 9, wherein the heating element is a gas burner formed to partially surround the convection fan.

14. The cooking appliance of claim 9, further including a reflector plate within the accommodation space and attached to the back surface of the cooking chamber.

15. A cooking appliance comprising:

a main body having a cooking chamber and including a back surface defining a rear boundary surface of the cooking chamber and a side surface defining a lateral boundary surface of the cooking chamber;

a fan cover provided at the back surface and forming an accommodation space inside of the cooking chamber, including a suction port at a front of the fan cover, and at least one exhaust port at at least one side of the fan cover;

a heating element installed in the accommodation space to generate heat;

a convection fan that generates a flow of air such that air in the cooking chamber is suctioned into the fan cover through the suction port, heated in the fan cover, and discharged to the cooking chamber through the at least one exhaust port, the flow of air being discharged to the cooking chamber toward the side surface through the at least one exhaust port to flow toward a front side of the cooking chamber at at least a certain rate when the side surface is spaced from the exhaust port by a first distance; and at least one guide vane, provided between the side surface and the at least one exhaust port, that guides the flow of air such that the air discharged toward the side surface through the at least one exhaust port flows toward the front side of the cooking chamber when the side surface is spaced from the exhaust port by a second distance which is greater than the first distance, wherein the at least one guide vane includes:

a coupling plate coupled to the main body inside of the cooking chamber; and a guide plate that protrudes from the coupling plate toward the front side of the cooking chamber and guides the flow of air discharged through the at least one exhaust port to be directed to the front side of the cooking chamber, wherein the guide plate includes a flow guide surface which is formed on a first side surface of the guide plate facing the at least one exhaust port, and which guides the flow of air discharged through the at least one exhaust port, and wherein the flow guide surface forms an inclined surface which is inclined in a direction between the front side of the cooking chamber and a direction of the flow of air discharged through the at least one exhaust port.

* * * * *